United States Patent [19]

Moore

[11] 4,177,229

[45] Dec. 4, 1979

[54] METHOD FOR PRODUCTION OF PRECAST MANHOLE BASES

[76] Inventor: Wayne O. Moore, P.O. Box 961, Mt. Vernon, Ill. 62864

[21] Appl. No.: 887,007

[22] Filed: Mar. 16, 1978

Related U.S. Application Data

[62] Division of Ser. No. 790,547, Apr. 25, 1977, Pat. No. 4,103,862.

[51] Int. Cl.[2] ..... B28B 7/04

[52] U.S. Cl. ..... 264/40.5; 249/145; 249/155; 249/156; 249/159; 249/177; 264/299

[58] Field of Search ..... 249/145, 155, 156, 159, 249/177; 425/182, 183, 185; 264/40.5, 333, 299

[56] References Cited

U.S. PATENT DOCUMENTS

| | | | |
|---|---|---|---|
| 1,314,725 | 9/1919 | Young | 249/159 X |
| 3,363,876 | 1/1968 | Moore | 249/145 |
| 4,077,599 | 3/1978 | Oland | 249/177 |
| 4,085,918 | 4/1978 | Wilkerson | 249/177 X |

*Primary Examiner*—Thomas P. Pavelko
*Attorney, Agent, or Firm*—McDougall, Hersh & Scott

[57] ABSTRACT

A method for producing precast manhole bases utilizing an apparatus consisting of a mold jacket defining vertical walls and a mold form disposed within the jacket. The form includes a central portion spaced inwardly from the jacket and channel forming members extending over the central portion with inserts attached to the channel forming members and extending into contact with the jacket walls. When concrete is poured over the mold form and allowed to solidify, the bottom wall of the base forms over the central portion with the channel forming members defining the channels in the bottom wall of the base. The channel forming members consist of a first member attachable in a fixed position on the central portion, this first channel forming member being shaped for defining an effluent channel and a central basin in the mold base. One or more additional channel forming members extend radially from the basin, and these include locking means for fixing the members in any desired position relative to the basin. The method includes utilizing a protractor means adapted to be attached to the first channel forming member. The protractor extends over the radially extending members, and these members can then be precisely located in any desired angular position relative to the first channel forming member and then locked in place.

3 Claims, 11 Drawing Figures

FIG. 1
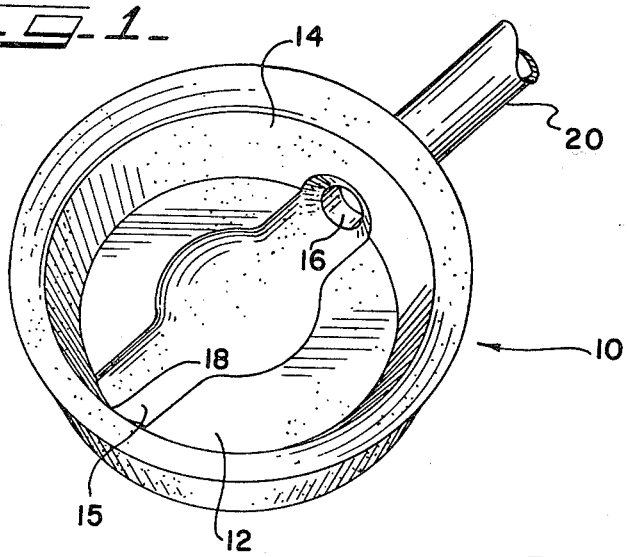
FIG. 2
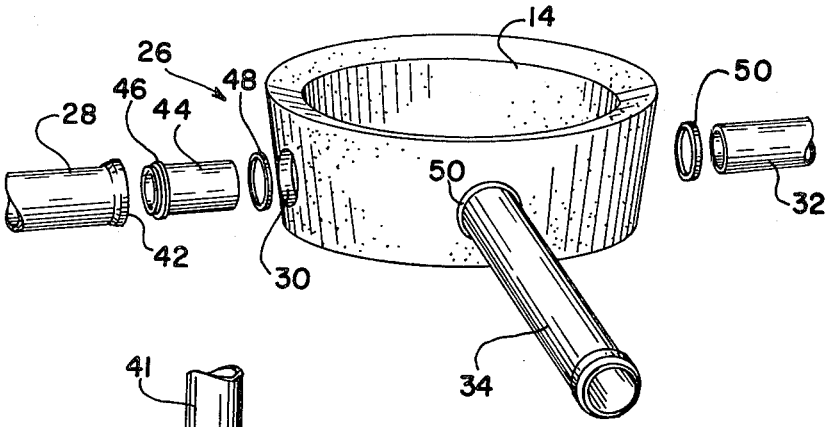
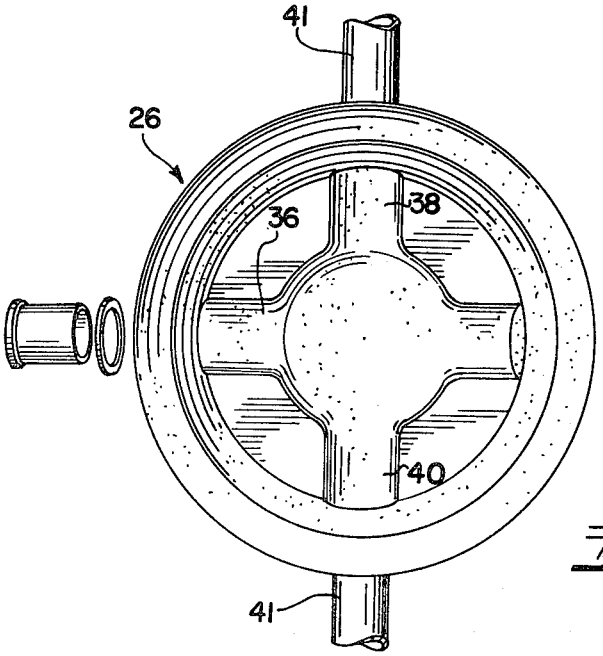
FIG. 3

METHOD FOR PRODUCTION OF PRECAST MANHOLE BASES

This is a division of application Ser. No. 790,547, filed Apr. 25, 1977, now U.S. Pat. No. 4,103,862.

This invention relates to a method for use in the formation of manholes. In particular, the invention is concerned with the production of precast manhole bases.

In the construction of sewers, it is necessary to provide manholes at spaced intervals to permit access to the sewer line. Such access is necessary to permit cleaning of the sewers and to simplify repairs to some extent.

The practice has been to provide manholes at relatively close intervals along sewer lines, and since virtually every construction project requires a sewer of some sort, there is a need for a large number of manholes. Certain methods employed for building of manholes have, however, proven undesirable from the standpoint of quality and also from the standpoint of expense due to the fact that such methods are time consuming and require relatively skilled labor.

More specifically, manholes have been built by first pouring concrete into the bottom of an excavation which is located in the sewer line. The concrete, when set, forms the base for a manhole and thereafter the walls can be located over the base through the use of precast cylindrical concrete members. If the precast members are not provided with openings for sewer pipe, it is then necessary to break away suitable openings. The process was somewhat simplified by preforming openings in the cylindrical members; however, in any case, it is necessary to seal the pipes with respect to the cylindrical members so that the only communication between the interior and the exterior of the manhole wall will be through the sewer pipe.

These prior techniques also often provide for the laying of the sewer pipe completely through the manhole excavation over the base which has been cast in place. After the cylindrical side walls are located with respect to the sewer pipe, the pipe is then broken away in the interior of the manhole to provide the necessary openings for the pipe within the manhole.

The above described techniques result in relatively high costs in manhole production and are also considered relatively deficient from the standpoint of quality. Insofar as cost is concerned, it is necessary to provide workers qualified for pouring and forming of concrete whereby the base or bottom wall of the manhole will be properly formed. It is also necessary to provide laborers for locating cylindrical walls over the base whereby the manhole can be built up to the desired height. Finally, the laying of the sewer pipe and the sealing of the pipe with respect to the manhole openings materially add to the labor costs involved.

The quality of manholes of the type described is often deficient and it is difficult to provide uniform quality even in a single construction project. Thus, the individual manholes depend for their quality on the skill and care of the workmen involved. Even with highly skilled workers, the manholes may not be properly formed due to conditions which prevail in the location of the manholes. For example, if the area is relatively wet, it is often difficult to provide for proper setting of concrete in the formation of the manhole base. Where wet conditions prevail, it is also difficult to provide for proper sealing of the sewer pipe with respect to the manhole walls.

Applicant, as described in U.S. Pat. No. 3,363,876 has developed a mold apparatus for manhole constructions, including precast manhole bases, whereby difficulties encountered in the formation of manholes can be largely eliminated and whereby the expense of manhole construction can be materially reduced. This mold apparatus specifically provides for the formation of precast manhole bases in a highly economical and efficient manner. The apparatus permits molding of manhole bases in a wide variety of configurations whereby the bases can be employed under any conditions necessary in the construction of sewers.

The molding apparatus of this prior patent permits utilization of essentially the same system in the formation of a wide variety of manhole base designs and sizes to thereby provide great efficiency and economy in construction. The bases produced are suitable for association with sewer pipes of any conventional size whereby a highly effective seal can be formed between the pipes and the manhole without the necessity for separate sealing operations to thereby greatly reduce the labor costs involved in producing manholes while at the same time providing high quality manholes.

The principal object of this invention is to provide an improved system for the production of precast manhole bases whereby a virtually infinite variety of base configurations can be obtained with a minimum of equipment in the way of molding structures.

It is a more specific object of this invention to provide a method for producing precast manhole bases whereby the channel forming members employed can be utilized for forming a main effluent channel and one or more influent, with the latter being locatable at any one of numerous angular positions relative to the main channel.

These and other objects of this invention will appear hereinafter and for purposes of illustration, but not of limitation, specific embodiments of this invention are shown in the accompanying drawings in which:

FIG. 1 is a perspective view of a manhole base produced in accordance with this invention;

FIG. 2 is a perspective view of a manhole base of the type described illustrating the manner in which sewer pipes are associated therewith;

FIG. 3 is a plan view of a manhole base illustrating an alternative channel pattern adapted to be formed by the techniques of this invention;

Figure 4:
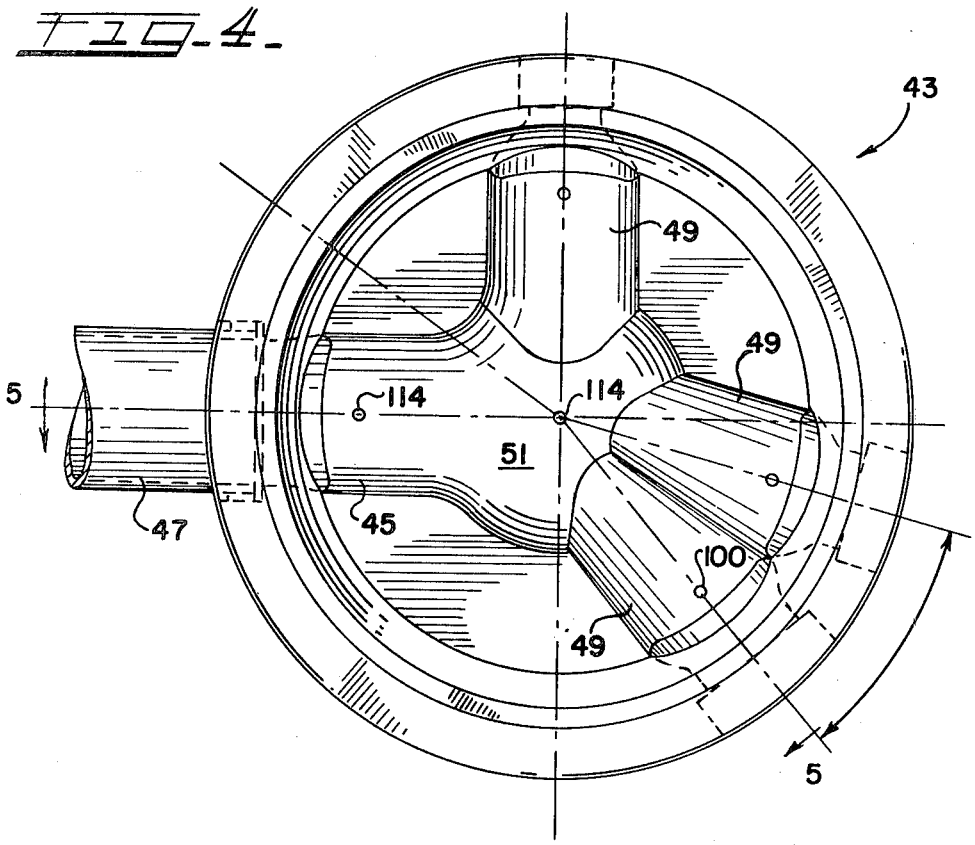
FIG. 4 is a plan view of a manhole base illustrating a still further alternative channel pattern adapted to be formed in accordance with the techniques of this invention.

Precast manhole bases generally comprise a bottom wall having associated therewith an enclosed upstanding side wall which is integrally cast with the bottom wall. Openings are defined in the side wall whereby sewer pipes can be attached to the base for the passage of sewage through the manhole. In the preferred form of the invention, channels are defined by the bottom wall for directing the sewage along a particular path.

Manhole bases can assume a wide variety of configurations. In many instances, a manhole will be included in a direct line whereby a linear flow-through channel and openings in the opposite side walls of the base will be provided. In other instances, a manhole is located at the juncture of two or more sewer lines and in such instances, a plurality of channels are provided, depending upon the number of lines involved. Finally, a manhole may be located in the main line of a sewer with branch lines feeding into the manhole and, in such instances, large diameter openings are associated in the same base with smaller diameter openings. The system described in the aforementioned U.S. Pat. No. 3,363,876 is adapted for the production of variations in sewer constructions. As will be apparent, however, that system demands the provision of certain channel forming members for each variation contemplated. Accordingly, because of the expense involved, the tendency is to develop channel forming members only for the more common variations.

As explained in the aforementioned patent, precast concrete manhole bases can be formed with a molding apparatus including a mold jacket defining walls which surround a mold form positioned within the jacket. This form comprises a base portion and an upwardly extending central portion, the central portion defining a top surface. This top surface extends short of the top edge of the jacket so that when concrete is poured into the jacket, the concrete fills the space between the jacket walls and the mold form while also covering the top surface of the mold form. This results in a manhole base having a bottom wall and upstanding side walls when the mold assembly is inverted and the jacket and mold form removed.

The system of the aforementioned patent provides for the formation of channels in the bottom wall of the manhole base and openings communicating with these channels and extending through the side walls of the manhole base. These channels and openings are provided by means of channel forming members and attached inserts. The channel forming members are positioned on the top surface of the mold form, and the inserts are attached to the channel forming members and extend outwardly therefrom to positions adjacent the jacket surfaces. By selecting given channel forming members and inserts, manhole bases of various configurations can be achieved, the number of variations depending upon the availability of different channel forming members and inserts.

The concepts of this invention particularly relate to the method employed for forming the channels in the bottom wall of the manhole base. The channel forming members utilized include a first member which is common to the system and which is attached to the top surface of the central portion of the mold form. Additional channel forming members are then provided for use in association with the first channel forming member. These additional members radiate outwardly from the center of the top surface of the mold form.

The additional channel forming members can be located at any angular position relative to the first member. Furthermore, any number of these additional channel forming members can be utilized within the size limitations of the structures. The invention can readily accommodate in the order of nine of these additional members which will satisfy virtually all, if not all, requirements.

The first channel forming member preferably defines an outer end with a channel section extending inwardly to an inner end in the form of an enlarged dish or basin shape. This central section defines curved walls and each of the additional channel forming members defines an inner end adapted to mate with these curved walls. This mating relationship is maintained in an angular position of the additional members relative to the central portion. This facilitates set-up of the construction since the additional members can be located on the top surface of the mold form and then readily moved to different radial locations until the desired location is determined. Locking means are provided so that each additional member can be fixed in place once the desired position is reached.

The invention contemplates a method for efficiently locating the additional channel forming members in place. Engineers' plans will indicate the relative angular positions of lines extending from a manhole base. This invention involves the use of a protractor and means associated with the channel forming members whereby the protractor can be located on these members and utilized for positioning the channel forming members in accordance with desired angular relationships. This system coupled with the use of easily operated locking means, enables the rapid and accurate positioning of the channel forming members.

The drawings (FIG. 1) illustrate a manhole base 10 which includes a bottom wall 12 and an upstanding annular side wall 14. A channel 15 of semicylindrical cross section is formed in the bottom wall. Openings 16 and 18 are defined by the side wall 14 to provide for flow of sewage or the like through the manhole. A sewer pipe 20 communicates with the opening 16 and a similar pipe is adapted to be connected at the opening 18.

The manhole base 26 shown in FIG. 2 is also provided with bottom and side walls as described with reference to FIG. 1. In this instance, however, additional openings are provided whereby a large sewer pipe 28 can be connected to the base through the opening 30 while smaller sewer pipes 32 and 34 can be attached at smaller diameter openings. A design of this nature is desirable where branch lines feed into a main line with the juncture being located at the manhole.

FIG. 3 illustrates a plan view of a base 26. In this instance, the bottom wall of the base defines a straight through channel 36 which "dead ends," and side channels 38 and 40. The pipes 41 represent branch lines connections adapted to feed into the main line with the flow being directed in the desired fashion.

FIGS. 2 and 3 also illustrate the manner in which the sewer pipes are preferably associated with the manhole bases of this invention. The pipe 28 includes a bell-shaped end 42, and an outlet joint member 44 is adapted to fit into the end 42. A plastic adaptor ring 46 is molded to the pipe member 44 whereby the connection with the pipe end 42 will be tight whereby providing the desired sealing relationship. A similar adaptor ring 48 is located around the other end of the joint member 44 for sealing relationship of this joint and with the opening 30.

As set forth in the aforementioned patent, various conventional adaptor rings of plastic and related materials are suitable for the purposes of this invention. The use of the plastic coupling members is particularly suitable since the use of such rings facilitates operations wherein clay pipe is employed. Concrete, asbestos cement, clay, plastic, and cast iron pipe are, however, all suited for use in applying the concepts of this invention.

Connection of the sewer pipes can also be accomplished in the manner shown in FIG. 2 wherein a plastic adaptor ring 50 is fit around the pipes 32 and 34. When these pipes are forced into their respective openings, a sealing relationship can readily be achieved. It will be appreciated that additional sealing can be accomplished by the use of conventional sealing compounds at these points; however, the system described employing plastic rings is considered fully suitable for sewer operations. In this connection, it will be noted that the use of a joint member 44 is highly desirable since these members can be cut to any desired length whereby pipes 28 of conventional sizes can be employed with the joints 44 being utilized to span any distances between the end of the last pipe and the opening in the manhole base.

Figure 5:
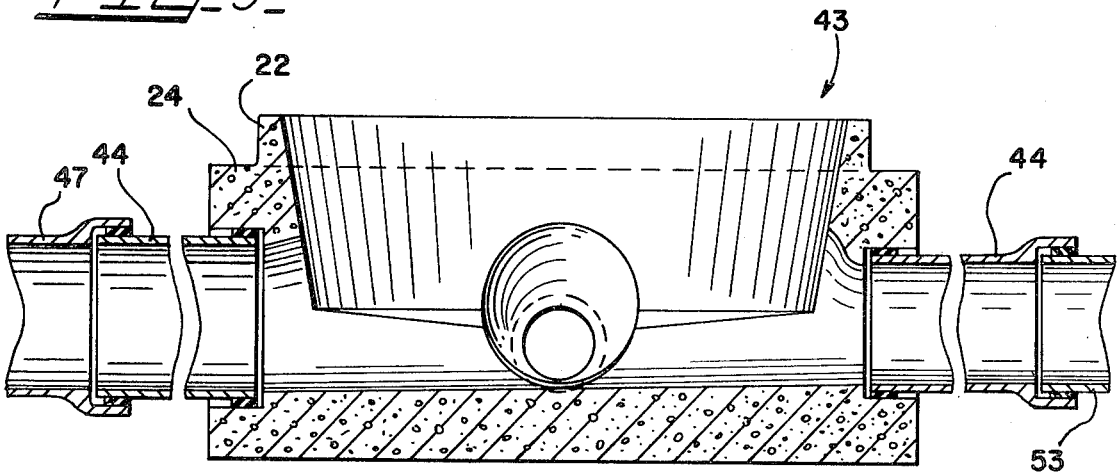
FIG. 5 is a cross-sectional view taken about the line 5—5 of FIG. 4.

FIGS. 4 and 5 illustrate another variation of a precast manhole base. This base 43 includes a main effluent channel 45 connected to the effluent pipe 47. Three influent channels 49 feed into the basin 51 formed at the end of the effluent channel 45.

As best shown in FIG. 5, a joint member 44 may be utilized for attaching effluent pipe 47 as well as influent pipes 53. The manhole base 43 is also characterized by an annular flange portion 22 which extends upwardly from the top edge 24 of the side wall. This flange portion serves as a guide member for the proper location of a concrete cylindrical riser. These risers are preferably precast members, and any number can be located in series depending upon the desired depth of the manhole. Where a base of the type shown in FIG. 4 is employed, the riser may comprise a member having an interior diameter slightly larger than the exterior diameter of the flange 22 whereby the riser will fit around the flange and rest on the top edge 24.

FIGS. 6 through 11 illustrate the details of the preferred molding mechanisms used in the practice of this invention. As set forth in the aforementioned patent, the mold construction illustrated is adapted to be mounted on a cradle member which includes a horizontal bed and upstanding ends. This arrangement permits inverting of the mold after pouring of the concrete. The mold form is adapted to rest on the bed along with the mold jacket 60 which is provided for enclosing the mold form.

The mold form 50 comprises a base or flange portion 64 and a central portion 66 which extends upwardly from the base. The top surface of the central portion is designated by numeral 68.

The top surface 68 supports a first channel forming member 70, this member consisting of a channel section 72 and a centrally located basin section 74. Suitable means are employed for locking this section in position on the top surface 68 of the mold form. Since this is a common member in terms of the bases to be formed, the member 70 may be bolted in place on the form 50. On the other hand, the locking means of FIG. 10, to be hereinafter described, could be utilized for holding the member 70 in place.

Figure 6:
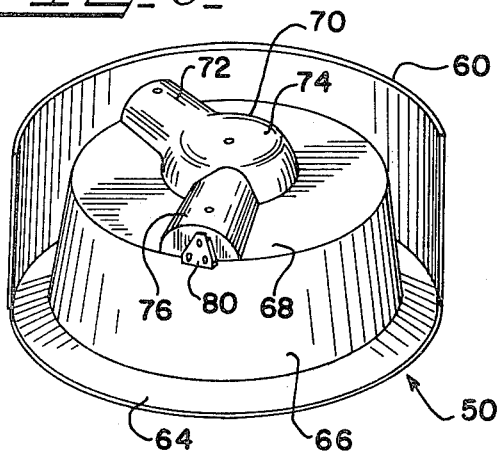
FIG. 6 is a perspective illustration of the mold form utilized in accordance with this invention.
Figure 7:
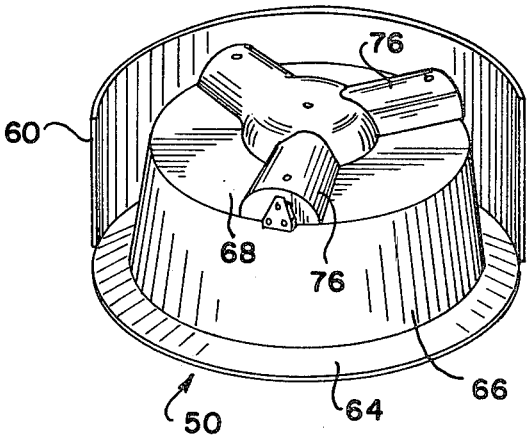
FIG. 7 is a perspective illustration of the mold form with an additional channel forming member.
Figure 8:
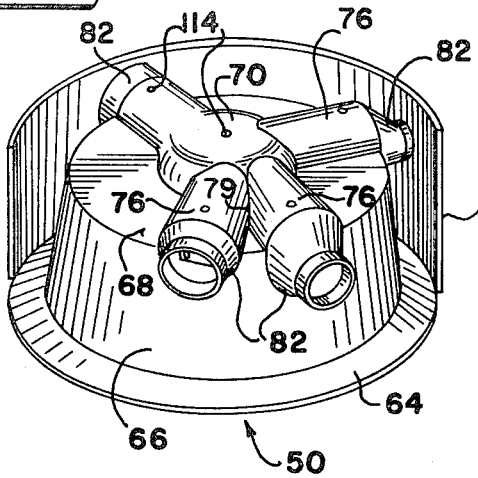
FIG. 8 is a perspective illustration of the mold form including a still further channel forming member and with mold inserts in place.

The invention also involves the use of one or more additional channel forming members 76 in association with the member 70. As shown in FIGS. 6 through 8, these members 76 define an inner end contoured to conform with the curved side walls of the basin section 74. Accordingly, the members 76 form a substantially closed junction with the walls of the basin section. Since the basin section defines a constant curvature around the center of the mold form, this closed junction is achieved irrespective of the radial position of the members 76. It will also be noted when referring to FIGS. 7 and 8 that a plurality of the members 76 can be located at different angular positions around the basin section.

The adjacent member 76 of FIG. 8 may have modified edges at their junction 79 to permit closer association of these members. Thus, it will be appreciated that the design of the additional channel forming members may be adjusted in various respects for purposes of increasing the versatility of the operations involved.

Each of the members 76 has a triangular hanging bracket 80 attached at its outer end. This facilitates the location of inserts 82 in the span between the ends of the channel forming members and the inner wall of the jacket 60. It will be understood that various conventional means can be employed for attaching the inserts to the ends of the channel forming members.

Figure 10:
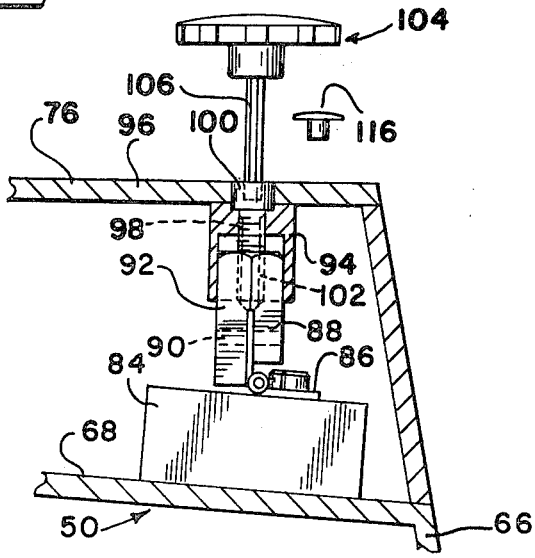
FIG. 10 is an enlarged fragmentary cross-sectional view illustrating locking means utilized in association with the channel forming members; and, FIG. 11 is a perspective view illustrating a mold arrangement for the formation of a dead end channel.

As shown, the channel forming members 76 define a semi-cylindrical cross section, and these members are adapted for movement over the surface 68 to various angular positions relative to the basin section 74. Furthermore, a plurality of the members 76 can be adjustably positioned on the surface 68, depending upon the specifications involved. FIG. 10 illustrates a preferred means for locking the members 76 in place once a desired angular position is achieved.

The locking means of FIG. 10 consists of a high power permanent magnet 84. This magnet is bolted to one leaf 86 of a hinge with the other leaf 88 attached by means of a pin 90 to a hex fitting 92. A complementary socket 94 is welded or otherwise attached to the underside of the top wall 96 of the channel forming member 76.

The socket 94 defines a bore receiving the threaded shank 98 of bolt 100. The shank 98 is received within a threaded bore 102 defined by the fitting 92 whereby rotation of the bolt will result in movement of the fitting 92 within the socket 94.

Tool 104 defines a hex shaft 106 receivable within a hex recess defined by the head of the bolt 100. In the use of the locking device described, the fitting 92 is normally retained in a retracted position, that is, completely backed into the socket 94. In this position, the magnet 84 is held in spaced relationship with the surface 68. Under these circumstances, the member 76 which supports the locking member can be shifted over the surface 68 to any desired position. The tool 104 is then employed for driving the fitting 92 outwardly of the socket 94 which eventually results in the attachment of permanent magnet 84 with the surface 68. By utilizing a high strength magnet, the member 76 will be very securely locked in place on the surface 68. It will be understood that suitable iron based materials are utilized for forming the mold form 50 to provide the necessary attraction for the magnet 84.

Figure 9:
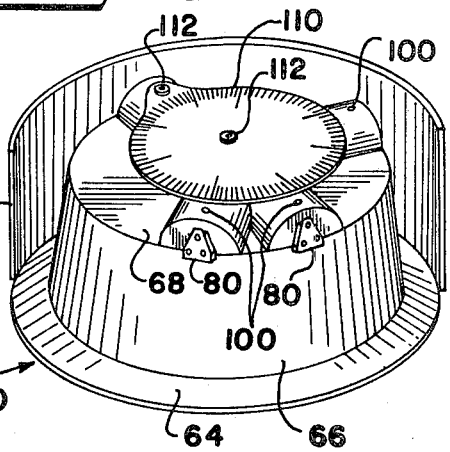
FIG. 9 is a perspective illustration of the mold form indicating the manner in which a protractor is employed in accordance with the method of the invention.

This invention contemplates a highly effective means for properly locating the members 76 relative to the member 70. Specifically, a protractor 110 is adapted to be located in position as shown in FIG. 9. This protractor includes first and second downwardly depending pins 112 and openings 114 are in turn defined by the channel forming member 70. With this arrangement, the pins can be located in the respective openings 114, and this will provide a zero reference point for the protractor directly in line with the axis of the channel forming member 70.

The axes of the members 76 can then be lined up at any desired angle relative to the member 70 by utilizing the protractor. Thus, it will be noted that the protractor periphery extends over the members 76 adjacent the position of the bolt 100 associated with the locking device. These bolts are located on the central axis of the members 76 so that an accurate angular relation can be determined. It will be appreciated that once this relationship is achieved, the tool 104 can then be immediately employed to lock the members 76 in place.

Figure 11:
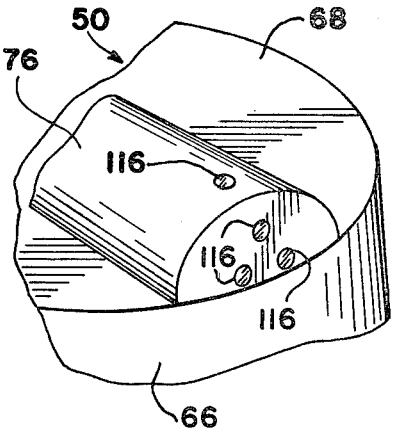

In order to insure a smooth cast surface and to avoid undue cleaning problems, the invention contemplates the use of a plastic plug 116 for openings which would otherwise develop in the forming members. Specifically, the plugs 116 may be attached to bolt 100 after a member 76 has been locked in place. FIG. 11 illustrates the use of plugs 116 in the openings normally provided for supporting a bracket 80 at the end of a forming member 76. In this instance, the bracket has been removed for purposes of achieving a "dead end" in the manhole base. Thus, an insert 82 is not attached in this instance so that the wall of the base will close the end of the channel formed by this member 76.

As indicated, the system described provides great versatility since numerous configurations can be provided with a minimum number of forming members. The first forming member 70 is common to the various designs illustrated, and the other forming members 76 may all be of the same design. These members are then simply used in the desired number and at the desired angular positions to achieve a given configuration.

In the formation of bases, the procedures described in the aforementioned patent are followed. Thus, concrete is poured between the jacket and forms as illustrated in FIGS. 6 through 9, and after sufficient setting, the assembly is inverted. The jacket and the central portion along with the forming members 70 and 76 are removed. The inserts are then knocked out and no significant finishing operations are required prior to utilization in a sewer line.

The technique of this invention including the provision of the basin section 74 provides an additional advantage when installing sewers utilizing the precast bases. Specifically, laser means are now commonly used for aligning pipe in sewer installations. The basins provided in the precast bases of this invention provide a highly convenient means for setting up the laser devices. Thus, a regular, substantially flat platform is made available.

It will be understood that various changes and modifications may be made in the above described system which provide the characteristics of this invention without departing from the spirit thereof particularly as set forth in the following claims.

That which is claimed is:

1. In a method for producing precast concrete manhole bases wherein a mold jacket is positioned in surrounding relationship relative to a mold form, said form defining a base extending to the interior face of said jacket and a central portion extending upwardly from said base in inwardly spaced relationship with said interior face of said jacket, the central portion having a top surface for supporting channel forming members, and wherein concrete is poured over said mold form for solidification of the concrete between the mold form and the jacket and over the mold form, the improvement comprising the steps of locating a first channel forming member on said top surface, said first channel forming member consisting of a central section and a radially extending section, and at least one additional member on said top surface extending radially outwardly from said central section, said central section of said first member defining a curved outer surface and the inner end of said additional member defining a mating curved surface, fixing said first member in position, positioning a protractor on said first member and fixing the position of the protractor, providing reference points on said additional member, moving said additional member over said top surface, holding said inner end against said central section during movement of said additional member over said top surface, said mating surface and end providing accurate positioning of said additional member relative to said first member, measuring the angular relationship between said first member and said additional member by means of said protractor, and locking said additional member to said top surface when a desired angular relationship is achieved.

2. A method in accordance with claim 1 including the steps of providing a plurality of additional members, moving each of the additional members over said top surface while observing the angular relationships between said additional members and said first member, and locking each of said additional members in position on said top surface.

3. A method in accordance with claim 1 wherein said additional member defines an opening for receiving a tool utilized for locking said additional member to said top surface, and including the steps of removing said tool and plugging of said opening subsequent to locking of said additional member and prior to casting of a manhole base.

* * * * *